United States Patent [19]

Tacheny et al.

[11] 4,362,328

[45] Dec. 7, 1982

[54] PATIO DOOR LOCK

[75] Inventors: John C. Tacheny, Owatonna; Gary F. Paulson, Waseca; Jerome W. Natzel, Owatonna, all of Minn.

[73] Assignee: Truth Incorporated, Owatonna, Minn.

[21] Appl. No.: 150,714

[22] Filed: May 19, 1980

[51] Int. Cl.[3] ..... E05C 1/12

[52] U.S. Cl. ..... 292/36

[58] Field of Search ..... 292/36, 33, 35, 32, 292/173, DIG. 46; 70/118, 119, 120

[56] References Cited

U.S. PATENT DOCUMENTS

| | | | |
|---|---|---|---|
| 652,279 | 6/1900 | Lauer . | |
| 998,642 | 7/1911 | Shean . | |
| 1,090,057 | 3/1914 | Hill | 70/118 X |
| 1,282,115 | 10/1918 | Older | 292/36 |
| 1,387,573 | 8/1921 | Wilson . | |
| 1,460,991 | 7/1923 | Van Alstyne . | |
| 1,593,435 | 7/1926 | Carter | 292/36 |
| 2,989,859 | 6/1961 | Eads . | |
| 3,245,237 | 4/1966 | Eads et al. . | |
| 3,413,933 | 12/1968 | Shook . | |
| 3,633,389 | 1/1972 | Horgan, Jr. . | |
| 3,768,847 | 10/1973 | Buck, Jr. . | |
| 4,088,353 | 5/1978 | Meyer | 292/36 |
| 4,120,524 | 10/1978 | Buck, Jr. . | |
| 4,165,894 | 8/1979 | Wojciechowski . | |

FOREIGN PATENT DOCUMENTS

| | | | |
|---|---|---|---|
| 376082 | 4/1907 | France | 292/36 |
| 936667 | 2/1948 | France | 292/36 |

*Primary Examiner*—Roy D. Frazier
*Assistant Examiner*—Peter A. Aschenbrenner
*Attorney, Agent, or Firm*—Wegner, McCord, Wood & Dalton

[57] ABSTRACT

A patio door lock having a linkage for reciprocating movable bolts in the top and bottom of the door into and out of locked positions. A six bar linkage is provided to reciprocate bolt rods connected to the bolts by axially directed forces. A tension spring biases the bolt rods together, and stops are provided to limit an over-center motion of the linkage as assisted by the tension spring, one stop holding the linkage and bolt bars in the locked position.

4 Claims, 7 Drawing Figures

PATIO DOOR LOCK

TECHNICAL FIELD

The invention relates generally to a door lock and more particularly to a linkage contained within the door for reciprocating bolts from the top and bottom of a sliding patio door.

BACKGROUND ART

Patio door locking mechanisms are typically centrally located at the end of a door and reciprocate a bolt or bolts at both the top and bottom of the door between locked and unlocked positions. These mechanisms have been constructed with linkage arrangements which reciprocate both bolts together. However, the linkages which have been used have directed forces at relatively large angles to the desired reciprocal direction of motion and thus have created frictional forces in slider joints which inhibit the movement of the mechanism. The friction also tends to increase wear on the linkage components, thereby reducing the life span of the mechanism.

Prior mechanisms have had the components constructed and arranged whereby substantial space is required and which is difficult to provide in a door such as a sliding patio door wherein the glass panels are surrounded by a narrow frame.

An example of a linkage used heretofore is shown in U.S. Pat. No. 998,642, issued July 25, 1911, showing a four bar linkage of the slider crank type applied to non-aligned bolts. The links apply as much undesirable lateral force to the actuating rods for the bolts as they do axial force, thereby causing the rods to bind and wear against the guide bracket plates. The sliding of the rods in the guide bracket plates not only creates friction which inhibits vertical motion of the rods, that friction further causes wear between the rods and guide plates, thereby shortening the life span of the working parts.

The present invention is directed to overcoming one or more of the problems as set forth above.

DISCLOSURE OF THE INVENTION

A primary feature of the invention disclosed herein is to provide a door lock for a sliding door having a pair of vertically aligned slidable bolts for locking engagement with a pair of keepers mounted at the top and bottom of a door frame, means disposed within the frame of the sliding door for positioning of the bolts including a pair of bolt rods in substantial alignment along a vertical axis and connected at one of their ends to the bolts, and operating structure having minimal wear pivot pin connections for translating movement of a rotatable operator to actuating forces on said bolt rods arranged to exert primarily axial forces on said bolt rods for minimal resistance to actuating movement of said bolts.

Still another feature of the invention is to provide lock structure as defined in the preceding paragraph wherein linkage structure interconnects the rotatable operator with the bolt rods and the linkage structure is constructed to go over-center in either a locked or unlocked position and as urged thereto by spring means to provide for positive retention of the bolts in the desired position and provide a positive feel in operation of the door lock.

In one aspect of the present invention, a door lock linkage is provided having a driver or operator which is rotatably fixed to the door and connected by linking arms to two ternary links (members with three revolute joints). Each ternary link pivots around a fixed point at one end and is pivotally connected to a bolt rod at the other. The two bolt rods extend from that connection to the top and bottom of the door where they are connected to bolts which reciprocate into and out of locking position.

In another aspect of the present invention, the above-described linkage has a spring biasing the bolt rods together which applies forces through the ternary links and linking arms to create a moment couple on the operator. Also provided are stops for limiting the motion of the operator. At one intermediate position of the linkage within the range of motion allowed by the stops, the axes of the two linking arms align on the operator rotation axis. When the linkage is turned so that the two linking arms are out of alignment with said axis, the linkage goes over-center in a direction dependent upon the alignment of the linking arms. This enables the linkage to hold itself in either the locked or unlocked position, whichever is desired.

The linkage uses essentially only pivot pin joints with slider joints for the bolts. In the prior art, slider joints have been substantial features of the lock linkages and have been designed to prevent sideways (nonaxial) motion of the bolt rods. With the linkage used by this invention, the force applied to the bolt rods is directed axially of the bolt rods and thus there is virtually no tendency toward transverse motion. The small amount which does exist may be permitted to occur, either by allowing slight play in the slider joint at the bolts or by permitting slight bending of the bolt bars themselves. By virtually eliminating the tendency toward the undesirable lateral motion, the restraints against such motion may also be eliminated. Such restraints have imposed large frictional forces which have both hindered free movement of the linkage and increased wear on the linkage components, and therefore the elimination of these restraints is a highly desirable feature.

The provision of the linkage as described above also enables a single spring to be used to hold the linkage in whichever position (locked or unlocked) is desired. The provision of a single spring to secure the linkage in either of its over-center positions eliminates the necessity for more complex biasing arrangements.

DESCRIPTION OF THE PREFERRED EMBODIMENT

Figure 1:
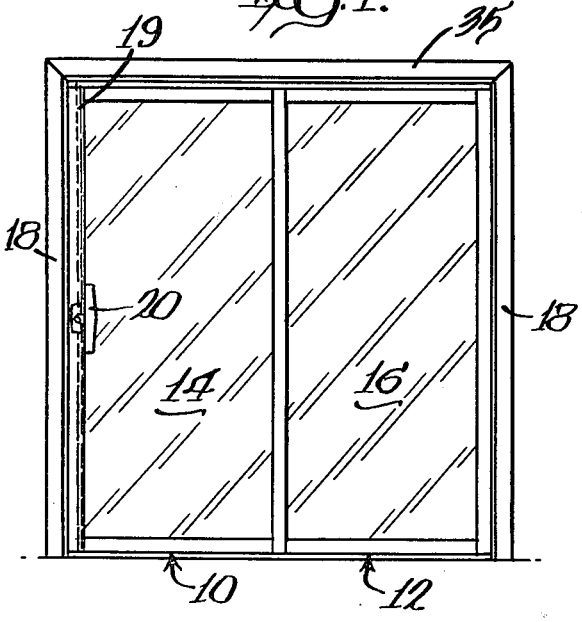
FIG. 1 shows a conventional door frame and patio door structure having the inventive lock linkage within one vertical side of the door.

A sliding patio door assembly is shown generally at FIG. 1. The door assembly consists of two doors 10,12, each of which have a frame which surrounds and encloses glass panels 14,16. The door 12 is stationary while the door 10 is movable back and forth within the door frame 18, and may align with the door 12 to leave an open portion through which people may pass. A stile 19 of the door 10 abuts the door frame 18 when the door is closed and has a handle 20 and a lock and linkage assembly which enables the door 10 to be locked in the closed position.

Figure 2:
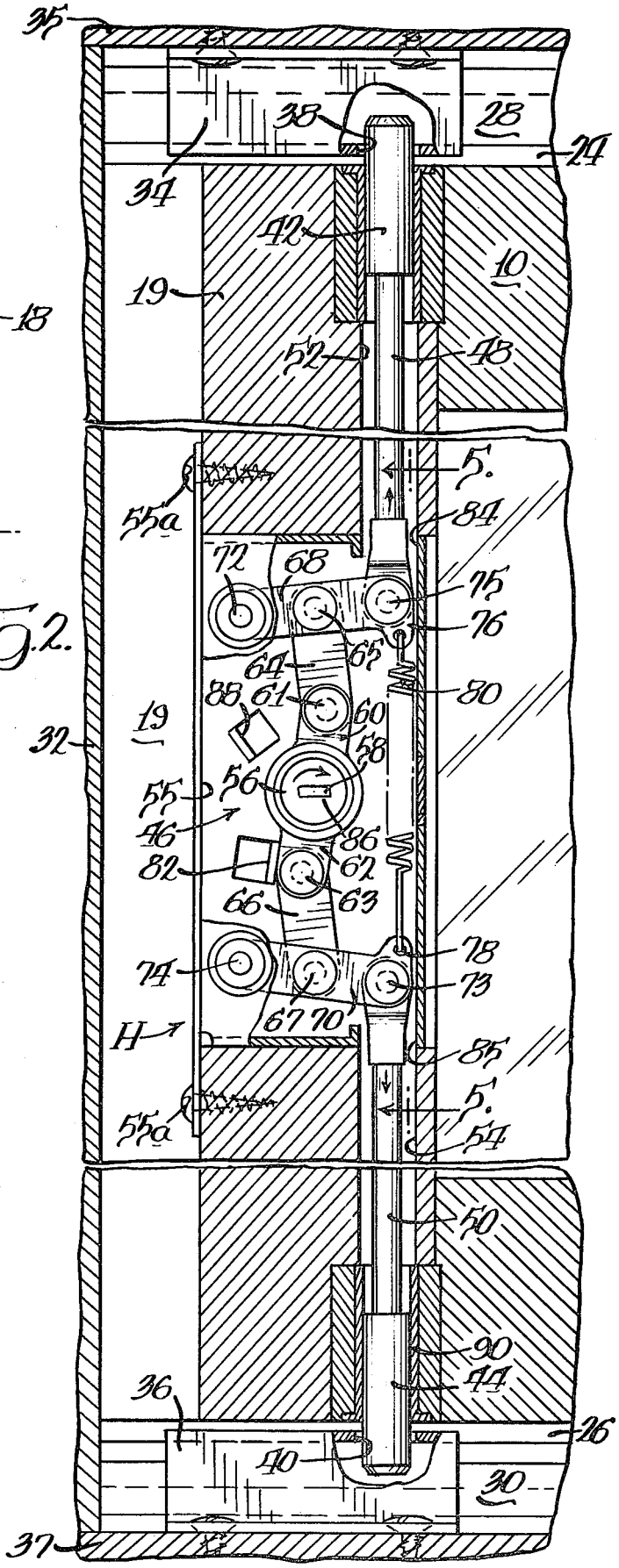
FIG. 2 is an enlarged fragmentary view of the lock linkage with the linkage in a locked position and showing components of the door and door frame.

The lock and linkage assembly is shown in FIG. 2. This figure shows a vertical central section through the panel frame stile 19 and upper rail 24 and lower rail 26. The upper and lower rails are channels which interfit with upper and lower guide tracks 28,30. The stile 19 is also a channel member and abuts against a jamb 32 at the end of the door frame 18 in a conventional manner to provide a tight seal when closed.

Upper and lower keepers 34,36 are associated with the door header 35 and door sill 37 and have openings 38,40 therein for receiving upper and lower bolts 42,44 for locking the door 10 in place.

Figure 3:
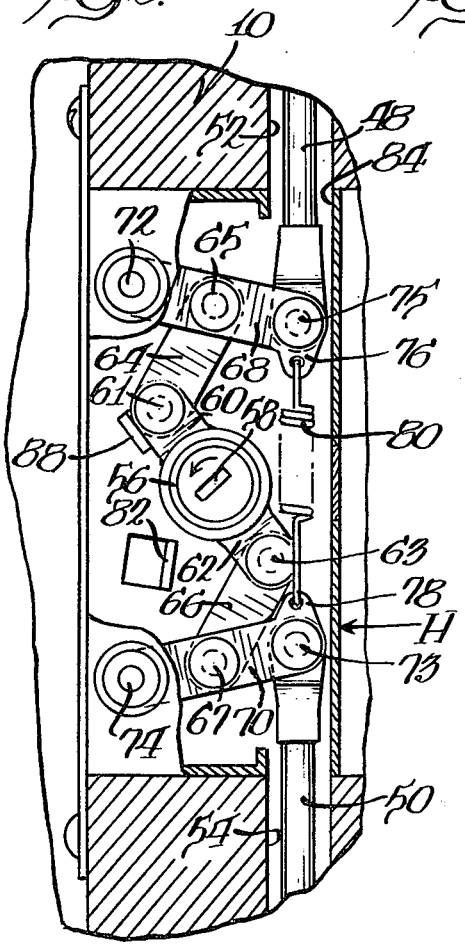
FIG. 3 is a fragmentary view of a central part of the lock linkage in the unlocked position.

The linkage for moving the bolts 42,44 between locked and unlocked positions is shown in FIGS. 2 and 3. The bolts 42,44 are connected to the central linkage, shown generally at 46, by bolt rods 48,50 which may reciprocate within enclosures 52,54 in the stile 19.

The central linkage and an operator are mounted in a housing, indicated generally at H, having side walls providing pivot points for certain links. The housing fits into an opening in the stile 19 and a housing wall 55 is attached to the stile by members 55*a*.

The linkage comprises an operator 56 rotatable about an axis 58 within the housing H and having opposing radially extending arms 60,62. Each arm is in turn pivotally connected at 61 and 63 to one end of a link 64,66. The other ends of the links 64,66 are pivotally connected at 65 and 67 to intermediate points on straight ternary links 68,70 (ternary links being links which have three pivot points). One end of each ternary link 68,70 is pivotally mounted at pivot points 72,74 to the housing H and the other ends are pivotally connected to the ends of the bolt rods 48,50 at 73 and 75. Both ternary links 68,70 at their pivot connections 73,75 with the bolt rods 48,50 have tabs 76,78 between which is extended a tension spring 80.

The pivot connections at the pivot points are provided by pivot pins suitably held in position. The bolt rods 48 and 50 extend outwardly through openings 84 and 85 in the housing H.

As can be seen from FIGS. 2 and 3, the linkage assembly on both sides of the driver 56 are essentially identical. FIG. 2 shows the assembly in the locked position with the bolts 42,44 extended into the keepers 34,36. The tension spring 80 biases the ternary links 68,70 toward inward pivotal movement toward the center axis 58. This bias is transmitted through the attached arms 64,66 to create a moment couple on the operator 56 through its arms 60,62 to bias the operator 56 toward clockwise pivoting. This bias moves the arms 60,62 and links 64,66 over-center to a position limited by a stop 82 abutting against the lower arm 62.

To move the linkage to an unlocked position, the operator 56 is manually turned counterclockwise. The handle 20 extends into the slot 86 in the operator 56 to enable such manual turning. When turned beyond the point where the arms 64,66 align with the axis 58 of the operator 56, the spring 80 causes the arms 64,66 to apply an oppositely directed moment couple so as to bias the operator 56 toward counterclockwise rotation. The spring 80 thus moves the operator 56 in counterclockwise rotation until the upper arm 60 of the operator 56 engages an upper stop 88 on the housing H. This motion moves the linkage to an opposite over-center position and pulls together the outer ends of the ternary links 68,70, also pulling together the bolt rods 48,50 and disengaging the bolts 42,44 from the keepers 34,36. This position is shown in FIG. 3.

Figure 4:
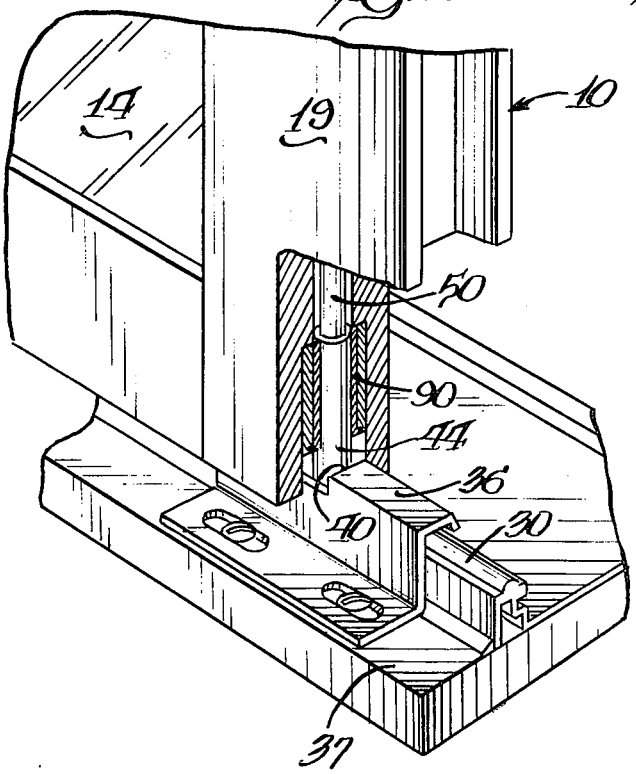
FIG. 4 is a perspective partially broken view of the bolt and track assembly at the lower corner of the door.
Figure 5:
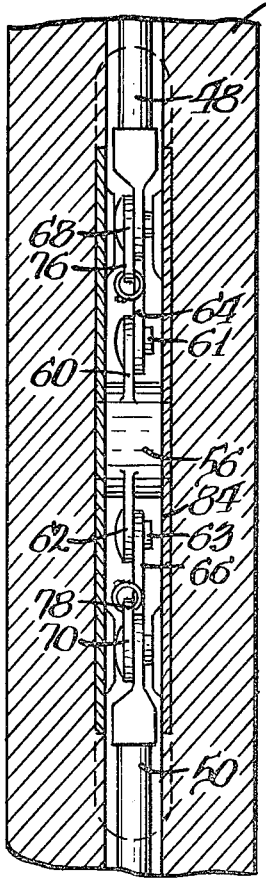
FIG. 5 is a sectional view taken generally along the line 5—5 in FIG. 2.

FIG. 4 shows the bottom bolt assembly on the door. The track 30, keeper 36 and stile 19 are of essentially typical configuration. The bolt 44 is reciprocally received in a bolt guide 90. In the preferred embodiment of this invention, very slight axial pivoting of the bolt 44 within the guide 90 is permissable to account for the very slight tilting of the bolt rod 50 which occurs when the attached ternary link 70 pivots about its fixed pivot point 74. Because the ternary link 70 is aligned approximately perpendicular to the direction of reciprocal movement of the rod 50, this nonaxial movement is minimized. The bolt 44 is prevented from binding in its guide 90 when such twisting occurs by permitting some play between the bolt 44 and guide 90. Alternatively, the bolt rod 50 which is used may be made of a material which will accommodate this slight axial bending. Because of the length of the bolt rod 50 over which this bending need occur and the relatively small bending which does occur, this would not require any special material. The conventional rods which are currently used would accomplish this purpose.

Figure 6A:
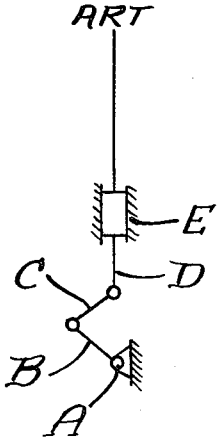
Fig. 6A. PRIOR ART
FIG. 6A is a line diagram of the prior art linkage.
Figure 6B:
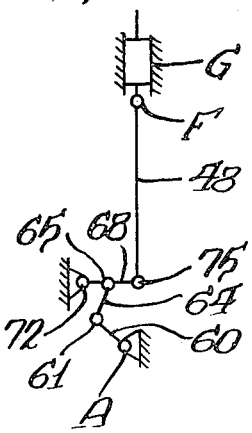
FIG. 6B is a line diagram of the invention.

A contrast of the link type used by this invention with those used in prior art is made in FIGS. 6A and 6B. Only half the link assembly is shown for both types with the lower fixed pivot points A being equivalent to the center axis 58 of the operator 56.

The linkage type shown in FIG. 6A is known as a four bar crank slider type (the fixed points together being considered as a single bar) and is the type used in the U.S. Pat. No. 998,642 discussed above. When the operator is turned, the arm B of the operator pivots to move the attached link C. Because link C can only direct forces along its axis, and since the link C is at approximately 45° to the slider portion D of the linkage, only about half of the force applied by the link C is used to reciprocate the slider D up and down. The other half of the force is dissipated within the slider D which is forced against the walls E, greatly increasing frictional forces thereon.

Although it would be possible to establish a linkage such as in FIG. 6A wherein the slider D were approximately aligned with its attached link C and the operator arm B approximately perpendicular thereto, this type linkage would be highly undesirable for patio doors since it would require that its two halves (i.e. the two rods going to the upper and lower bolts) be out of alignment. This would require that the frame be widened to accommodate this assembly, such widening being highly undesirable in patio doors where it is desired to maximize the glass area.

The linkage used in this invention is shown in FIG. 6B, with a pivot connection F near the sliding joint G merely being a representation of the slight pivoting which actually occurs within the sliding joint. It is similar to the Watt II six-bar class of linkages known to those skilled in the art of kinematics as having six bars including the ternary link 68. This linkage enables the force applied to the rod 48 to be generally axially directed and at the same time enables the rods to be aligned with one another. The desirability of these features in patio doors has already been detailed. And, as has also already been stated, a single spring may bias the assembly to retain it in a desired position, whether that be locked or unlocked.

With the structure disclosed herein, the operator 56 may be easily rotated to move the bolts between locked and unlocked position because of the mechanical advantage derived from the linkage structure as well as the lack of any significant sliding action of the parts and relatively low friction losses at the various pivotal mountings and pivotal connections in the linkage structure. The bias created by the interconnecting spring 80 and the over-center action of the linkage provides a positive feel in manual operation of the lock mechanism.

The actuating structure can be assembled into the housing H and, thereafter, the housing mounted in the stile and connections made to the bolt rods 48 and 50 which extend to the bolts 42 and 44. This results in a compact, easily-installed structure which can be economically manufactured with simple stampings and die castings. The structure is internally mounted on the stile 19 for enhanced security.

We claim:

1. A door lock for a movable door having a pair of vertically aligned movable bolts positioned one at the top and one at the bottom of the door for locking engagement with a pair of keepers mounted at the top and bottom of the door frame, and means for positioning said bolts including a pair of bolt rods in substantial alignment along a vertical axis and connected one to each of the bolts at their outer ends and having their inner ends positioned at a distance from each other, a rotatable operator disposed in the space between said inner ends, a pair of bolt rod actuating links each pivotally fixed relative to the door and extending generally normal to the length of said bolt rods, each of said links being pivotally connected to one of said bolt rods at a connection lying in said vertical axis, and means interconnecting said rotatable operator and said links for movement of said links through a relatively short arc which is generally along said vertical axis to exert force axially of said bolt rods, said interconnecting means including an over-center link structure, spring means effective to urge said link structure over-center, and stop means for limiting movement of said link structure in either direction beyond said over-center position.

2. A door lock as defined in claim 1 wherein said spring means comprises a spring connected between said bolt rods and extending along said vertical axis.

3. A door lock as defined in claim 2 wherein the recited structure is located within a frame member extending along a vertical edge of the door.

4. In a patio door lock mountable inside a door and having reciprocating bolt structure including vertically-aligned bolt rods, an improved linkage comprising:

an upper lever arm pivotally fixed at one end relative to said door and pivotally connected at the other end to an upper one of said bolt rods;

a lower lever arm pivotally fixed at one end relative to said door and pivotally connected at the other end to a lower one of said bolt rods;

a rotatable operator positioned between said lever arms;

a first link pivotally connected at one end to an intermediate point on said upper lever arm and pivotally connected at the other end to said rotatable operator;

a second link pivotally connected at one end to an intermediate point on said lower lever arm and pivotally connected at the other end to said rotatable operator;

said pivotal connections of the links to the rotatable operator being diametrically opposite each other;

a pair of stops fixed relative to the door and stop-engaging means on the rotatable operator for limiting rotation of the rotatable operator to movement between positions which cause the bolt structure to be either extended or retracted, and a spring extending in alignment with the bolt structure and operatively connected to adjacent ends of the bolt rods and acting in a direction to retract the bolt structure and to urge said stop-engaging means into engagement with one or the other of said stops.

* * * * *